United States Patent [19]

Franzson

[11] 3,977,581

[45] Aug. 31, 1976

[54] METHOD AND APPARATUS FOR APPLYING GARMENT DECORATION

[75] Inventor: John Franzson, Parsippany, N.J.

[73] Assignee: Precision Assembly Corporation, West Orange, N.J.

[22] Filed: May 28, 1975

[21] Appl. No.: 581,642

[52] U.S. Cl. ..... 223/44

[51] Int. Cl.[2] ..... A41H 43/00

[58] Field of Search ..... 223/44–48, 223/1; 2/243 R, 243 A, 243 B, 244, 265; 33/12–16; 63/26; 112/104–110, 265; 156/63

[56] References Cited

UNITED STATES PATENTS

| | | | |
|---|---|---|---|
| 1,326,311 | 12/1919 | Trueb | 223/44 |
| 1,943,658 | 1/1934 | Dyckma | 428/51 |
| 3,484,319 | 12/1969 | Takenaka | 156/297 |
| 3,708,804 | 1/1973 | Santos | 2/244 |

*Primary Examiner*—G. V. Larkin
*Attorney, Agent, or Firm*—Samson Helfgott

[57] ABSTRACT

A kit for applying a decorative pattern to a garment utilizing a number of pronged studs. The kit includes a pattern formed by a plurality of dots on a surface material and a tool having a concave recess capable of fitting over the prongs of the studs and bending them inwardly upon application of a force. A base member is included having a flat support surface and capable of being easily penetrated by the prongs. The kit is utilized to apply the decoration with the head of the studs used as the ornamental part of the decoration, or ornamental stones can be placed within the prongs of the studs and held by the prongs so that the ornamental stones form the decorative pattern.

10 Claims, 13 Drawing Figures

METHOD AND APPARATUS FOR APPLYING GARMENT DECORATION

BACKGROUND OF THE INVENTION

This invention relates to a decorative pattern applied to a garment, and more particularly to a kit for applying a decorative pattern of studs or ornamental stones and a method for utilizing the kit.

One of the most important aspects in making a garment attractive is the decoration and ornamentation on the garment. A popular ornamentation includes designs or trimming which is formed by a series of metal studs having plain or fancy heads. Such studs are formed into various patterns such as animals, zodiac signs, or other objects. Similarly, such studs can be used as trimming along the edge of a collar, pocket, or cuff. In addition to decorating a garment with studs, another popular decoration is the use of rhinestones or other ornamental jewels which are also formed in a series to outline a particular picture of an object, animal, etc. Similarly, the rhinestones or other ornamental stones can be used as trimming along the edge of the garment.

The cost and time involved in applying such ornamentation generally increases the cost of the garment itself, and frequently makes such decorated garment either a specialty item or, when produced on a large scale, places the garment in an exceedingly high price range.

It has therefore been suggested to sell the garment individually and have the user apply the ornamental decoration himself. Various apparatus have been suggested for use in applying the ornamental studs or rhinestones. These apparatus generally include complex tools which involve spring loaded mechanisms, pressure devices, moving parts and complicated mechanical arrangements. Although these "do it yourself" apparatus have greatly reduced the cost of such decorated garments, the cost of the tool and associated equipment for self-applying the ornamentation, is still relatively expensive and extremely complicated to use. Furthermore, the tools have a tendency to break, wear out and become impaired after continued use. Since many of the ornamental patterns require hundreds of applied studs or rhinestones, it is sometimes necessary to purchase a separate costly tool for each garment being ornamented, whereby the cost of ornamenting a garment becomes quite high.

SUMMARY OF THE INVENTION

Accordingly, it is an object of the present invention to provide an apparatus for applying a decorative pattern to a garment which avoids the aforementioned problems of prior art devices.

Yet another object of the present invention is to provide an apparatus for applying a decorative pattern to a garment which is simple to manufacture, easy to utilize, and is relatively inexpensive.

A further object of the present invention is to provide a kit for applying a decorative pattern to a garment which includes the necessary studs, a unique pattern arrangement, and a combination of a unique tool with a base member for applying the studs to the garment in accordance with the pattern.

Still a further object of the present invention is to provide a kit for applying a decorative pattern to a garment, wherein the decorative pattern can be formed by means of ornamental studs or ornamental stones such as rhinestones.

Yet another object of the present invention is to provide a unique tool for applying studs with prongs to a garment in a very simple operation.

Still a further object of the present invention is to provide a tool for applying studs with prongs to a garment, whereby a portion of the tool can be interchanged to accommodate different sized studs.

A further object of the present invention is to provide a tool for applying studs to a garment wherein the studs either include an ornamental head, or permit the use of an ornamental stone such as a rhinestone.

A further object of the present invention is to provide a tool for applying studs to a garment wherein the tool is relatively easy to manufacture, simple to utilize and inexpensive to produce.

Yet a further object of the present invention is to provide a method for applying a decorative pattern to a garment using pronged studs, wherein the head of the stud is utilized to form the ornamental pattern.

A further object of the present invention is to provide a method of applying a decorative pattern to a garment using pronged studs, wherein ornamental stones such as rhinestones are inserted within the prongs and form the ornamental pattern.

Briefly, this invention comprises a kit for applying a decorative pattern to a garment and includes a tool having a cylindrical shaft with a tapered forward portion, the front end of the forward portion containing a concave recess. At least one stud is included, wherein the stud has a head portion and prongs extending therefrom. The concave recess on the tool is of a size to fit over the extended prongs and is capable of bending the prongs inwardly, deforming them, upon application of a force. The kit further includes a pattern formed by a plurality of dots on a surface material. Also, a base member is included which has a flat support surface capable of being easily penetrated by the prongs.

The invention further contemplates a method of utilizing the kit in applying a decorative pattern to a garment by placing the garment over the base member; putting the pattern over the garment, and inserting the studs through the pattern and the garment so that the prongs will penetrate the underlying base member. The garment is then turned over and the base member removed. The concave surface of the tool is then placed over the extended prongs and by means of an applied force the prongs are deformed and bent inwardly. The pattern can then be torn away from the garment.

These and other objects, features and advantages of the invention will, in part, be pointed out with particularity, and will in part become obvious from the following more detailed description of the invention, taken in conjunction with the accompanying drawings, which form an integral part thereof.

BRIEF DESCRIPTION OF THE DRAWINGS

In the drawings.

In the various figures of the drawing, like reference characters designate like parts.

DESCRIPTION OF THE PREFERRED EMBODIMENTS

Figure 1:
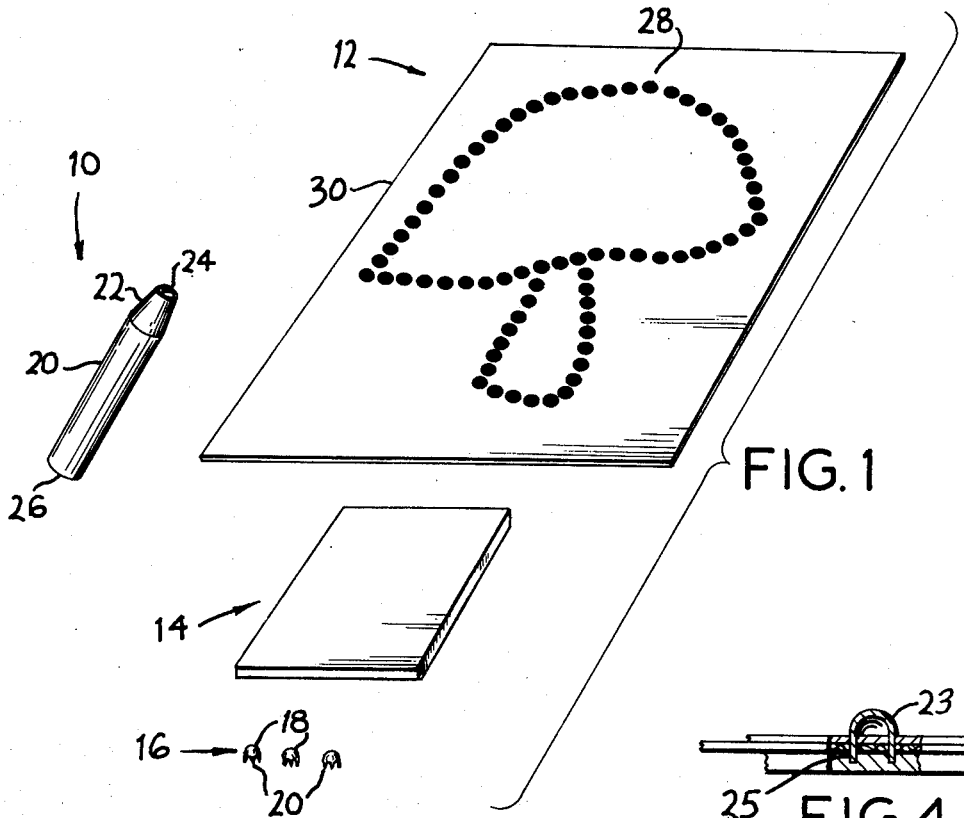
FIG. 1 is an isometric drawing of the various parts of the kit in accordance with one embodiment of the present invention.

Referring now to FIG. 1 there is shown one embodiment of the present invention describing a kit for applying a decorative pattern to a garment. The kit includes a tool shown generally at 10, a pattern shown generally at 12, a base member shown generally at 14 and at least one stud shown generally at 16.

Figure 2A:
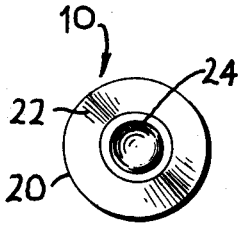
FIGS. 2*a*, 2*b*, and 2*c* represent various views of the tool shown in FIG. 1, and respectively show the top, bottom, and fragmentary sectional elevation view of the tool.
Figure 2B:
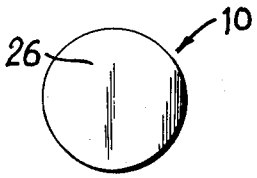
Figure 2C:
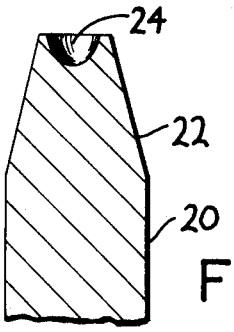

Referring to FIGS. 1 and 2, the tool includes a cylindrical shaft portion 20 with a tapered forward portion 22. The front end of the forward portion contains a concave recess 24 which extends inwardly from the front end. The base 26 of the cylindrical shaft is flat. The size of the cylindrical portion is large enough to be held in the hand of the user and is typically approximately 3 inches. The cylindrical shaft can be constructed in a solid piece together with the forward portion and the entire construction machined out of a single piece of metal such as aluminum or lightweight steel. Alternatively, the tool can be made of a plastic material and the base and head portion can be made of metallic material.

The pattern is formed by a plurality of dots 28 which are placed on a surface material 30, typically of paper or other such comparable thin substance. The pattern formed by the dots can be an object, such as a flower, mushroom, etc., or an animal such as a butterfly, fish, etc., or a zodiac sign or any such other pattern as desired.

The base member 14 includes a flat support surface which is capable of being penetrated by the prongs of the studs. Typically, the base member can be made of a corrugated piece of cardboard or other such similar material.

Figure 3:
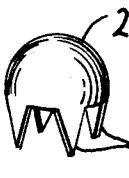
FIG. 3 is an isometric view of one embodiment of the stud.

The studs 16 include a head portion 18 and prongs 20 extending therefrom. Referring now to FIG. 3, one embodiment of the stud is shown which include a substantially round head portion 23 which is of rust-proof metallic material and is formed into an ornamental semi-circular configuration. Extending therefrom are the prongs 25 which are approximately triangular in shape and terminate in a generally pointy end. Four such prongs are shown extending from the head, although other numbers of prongs could be utilized depending upon the size of the stud. Furthermore, the studs can come in various sizes and various additional configurations whereby the head 23 could bear a decorative design.

Figure 4A:
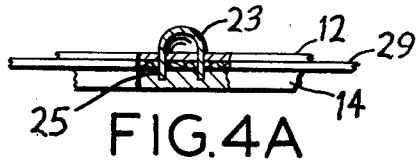
FIGS. 4*a*, 4*b*, and 4*c* show various steps in the method of applying the stud shown in FIG. 3.
Figure 4B:
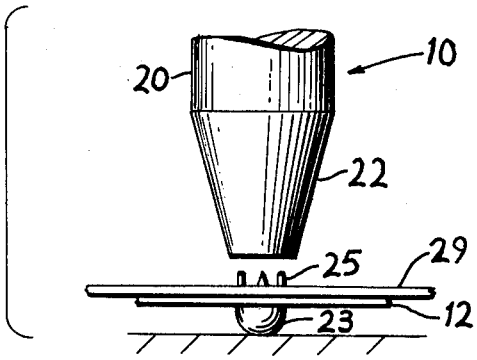
Figure 4C:
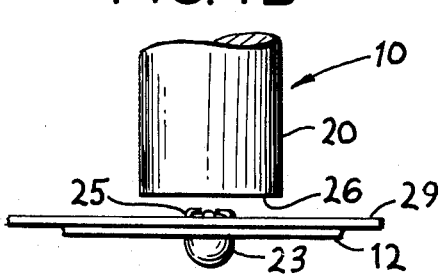

Referring now to FIGS. 4*a*, 4*b*, and 4*c*, the method of applying the stud shown in FIG. 3 and utilizing the kit of FIG. 1, will now be explained. The garment 29 to be decorated is placed over the base member 14 with the inner part of the garment such as the lining or other inner surface, facing the base member 14. The pattern

12 is then placed over the garment and is centered in the desired position. The pattern can be securely held in place by means of pins, tape, or other well known devices. The studs are then inserted by pressing them through the dots on the pattern so that they pass through the pattern, the garment and into the base member 14.

After the studs are inserted, the garment is turned over and the base member is removed, being careful not to remove the studs. The prongs will now be extending upward through the inner surface of the garment. The tapered end 22 of the tool 10 is then placed over the prongs 25 and force is applied onto the tool whereby the prongs will be deformed and bent inwardly. The tool is then turned over with its flat base end 26 the prongs are pressed downward so that they are securely tightened into a bent position.

For simple patterns all of the studs can be inserted at one time. However, for more complex patterns, it is beneficial to initially insert a small number of studs, tighten them, and repeat the process until the entire pattern is completed. After all of the studs are securely in place, the pattern is torn away. The studs can then be checked to make certain that all of the prongs are firmly and securely flat against the inside of the garment.

Figure 5:
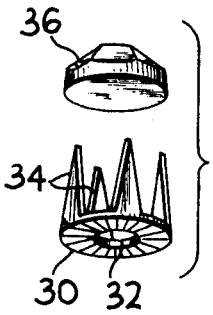
FIG. 5 shows an exploded isometric view of another embodiment of the stud.

Referring now to FIG. 5 a second embodiment of the stud is shown which includes a flat head portion 30, which typically includes centered hole 32, and prongs 34 extending therefrom. The prongs are again approximately triangular in shape ending in a point. An ornamental stone, such as a rhinestone 36 is also provided and is of a size which can be inserted within the prongs. When the prongs are deformed and bend inwardly, they will hold the rhinestone in place. Effectively, the stud forms a setting for the rhinestone.

Figure 6A:
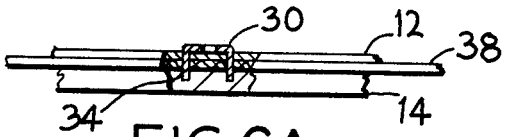
FIGS. 6*a*, and 6*b* show various steps in the method of applying the studs in FIG. 5.
Figure 6B:
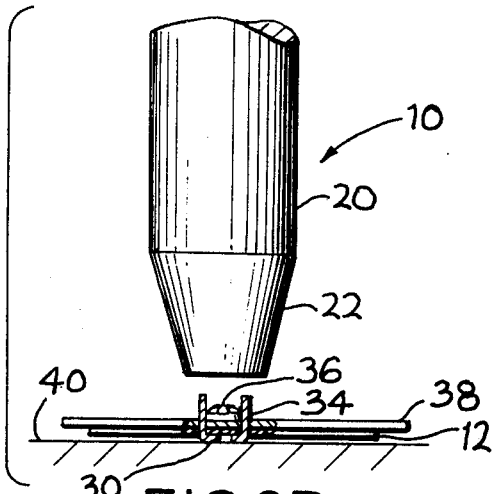

Referring now to FIGS. 6*a* and 6*b*, there will be described a method of utilizing the kit shown in FIG. 1 for applying the studs and ornamental stones shown in FIG. 5. The garment 38 is placed on the base member 14 with the outer surface of the garment facing the base member 14. The pattern 12 is centered in the desired area on the reverse side of the garment and is held in place by means of pins, tape, or other similar device. The studs are then inserted through the dots on the pattern so that the prongs pass through the pattern 12, the garment 38 and into the base member 14.

The garment is then turned over and with the flat head 30 resting on a flat surface 40 the base member 14 is removed being certain that all of the prongs remain extending through the material. The ornamental stones, such as rhinestones 36, are then inserted into the space between the prongs such that the ornamental part of the stone extends outwardly. The concave recess in the tapered part of the tool is then placed over the extended prongs and by applying a downward force on the prongs the prongs are deformed and bent inwardly over the top of the rhinestone 36 to hold the rhinestone securely in place. Occasionally, in addition to a downward force, a slight twist of the tool may be beneficial in deforming and bending the prongs.

Either all of the studs and rhinestones can be inserted at a single time or a few studs and rhinestones can be fastened and the process repeated until all of the rhinestones are securely in place. The pattern is then torn away. All of the applied rhinestones are then checked to make sure that the prongs are securely tightened against the rhinestones.

Although the method heretofore described has been in conjunction with a particular pattern, it is understood that each of the studs or the rhinestones could be set individually at particular places desired. Thus, the studs can be placed through the material with the prongs extending and in one embodiment the prongs can be bent inwardly by means of the tool. In the other embodiment, the rhinestone would be placed in the prongs and then the prongs bent inwardly using the tool.

Figure 7:
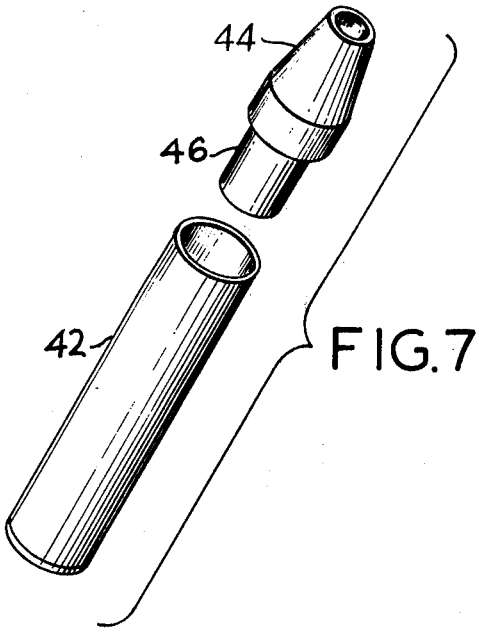
FIG. 7 shows an exploded isometric view of another embodiment of the tool in accordance with the present invention.
Figure 8:
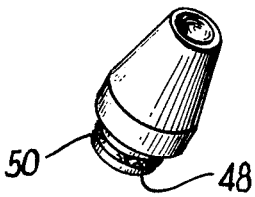
FIG. 8 shows an isometric view of a modification of the tool shown in FIG. 7.

Referring now to FIG. 7, there is shown an alternative embodiment of the tool heretofore described. As shown, the tool compresses a cylindrical tubular member 42 which is hollow on the inside thereof. The forward portion 44 is a separate piece which includes a stem 46 which can be inserted into the tubular member 42 and forms a tight sliding fit therewith. In this manner, different forward portions 44 can be inserted and utilized with the same cylindrical tubular member 42. Each of the different forward portions could have a different sized concave recess to accommodate different sized studs and prongs. Other methods could be used to retain the forward portions in the tubular member included, but not limited to, screw threads, a set screw, or clamp. For example, referring to FIG. 8, there is shown a forward portion having a circumferential groove 48 around the stem and an O-ring 50 positioned in the groove. The O-ring 50 could be of rubber, plastic, or the like, and provides a tight fit of the forward portion into the tubular member. The O-ring also prevents the forward portion from sliding out of the tubular member.

The pattern has been described as containing a plurality of dots and conveniently, the size of the dots would approximately be the size of the head of the studs. Furthermore, the pattern could comprise solid line portions with individual indications where the studs should be placed along the solid lines of the pattern by means of a special marking.

There has been disclosed heretofore the best embodiment of the invention presently contemplated. However, it is to be understood that various changes and modifications may be made thereto without departing from the spirit of the invention.

Having now described my invention, I claim as new and desire to secure by Letters Patent:

1. A kit for applying a decorative pattern to a garment comprising:

a. a tool having a cylindrical shaft portion with a tapered forward portion, the front end of said forward portion containing a concave recess;

b. at least one stud having a head portion and prongs extending therefrom, said concave recess being of a size to fit over said extended prongs and capable of bending them inwardly upon application of a force;

c. a pattern formed by a plurality of dots on a surface material, and d. a base member having a flat support surface capable of being easily penetrated by said prongs.

2. The kit as in claim 1 and wherein the size of the dots on the pattern approximates the size of the heads of the studs.

3. The kit as in claim 1 and wherein the head portion of the stud is substantially flat, and further comprising at least one ornamental stone capable of fitting within the extended prongs and adapted to be firmly held by the prongs bent inwardly.

4. The kit as in claim 1 and wherein said cylindrical shaft portion includes a flat base portion capable of securely tightening the prongs in a bent position.

5. The kit as in claim 1 and wherein said cylindrical shaft portion comprises a tubular member, and wherein said tapered forward portion includes a cylindrical stem adapted to slidably fit within said tubular member forming a tight fit therewith, whereby different forward portions, each with a different sized concave recess, can be coupled to the tubular member.

6. The kit as in claim 1 and wherein said base member is a cardboard material, said studs are of metal and said pattern is formed on paper material.

7. A method of applying a decorative pattern to a garment using pronged studs, in conjunction with a tool having a concave recess capable of fitting over the pronged studs, and a base member capable of being penetrated by the prongs, comprising the steps of:

a. placing the garment over the base member;

b. putting the pattern over the garment;

c. inserting the studs through the pattern and the garment so that the prongs will penetrate the underlying base member;

d. turning the garment over and removing the base member;

e. placing the concave recess of the tool over the extended prongs and by means of an applied force bending the prongs inwardly, and f. tearing away the pattern.

8. The method as in claim 7 wherein the garment is placed with its inner surface on the base member, and further comprising the step of using a flat portion of the tool to securely tighten the prongs in a bent position.

9. The method as in claim 7 wherein the garment is placed with its outer surface on the base member, and before bending the prongs said method further comprising the step of inserting an ornamental stone within the prongs whereby the bent prongs will retain the ornamental stone.

10. The method of claim 9 wherein said ornamental stone is a rhinestone.

* * * * *